United States Patent [19]

Quackenbush

[11] Patent Number: 4,773,608

[45] Date of Patent: Sep. 27, 1988

[54] PAPER ROLL DISPENSER

[76] Inventor: Michael J. Quackenbush, 13830 Jenny Dr., Warren, Mich. 48093

[21] Appl. No.: 61,414

[22] Filed: Jun. 12, 1987

[51] Int. Cl.[4] ..... B65H 19/04

[52] U.S. Cl. ..... 242/55.3; 242/55.53

[58] Field of Search ..... 242/55.3, 55.53, 55.2; 312/38, 39

[56] References Cited

U.S. PATENT DOCUMENTS

| | | | |
|---|---|---|---|
| 969,973 | 9/1910 | Nielsen et al. | 226/80 |
| 1,304,595 | 3/1919 | Peterson | 312/38 |
| 1,564,292 | 12/1925 | Steiner | 312/38 |
| 2,183,187 | 12/1939 | Freeman | 242/55.2 |
| 2,299,301 | 10/1942 | Britt et al. | 242/55.3 |
| 2,683,569 | 7/1954 | Morse | 242/55.3 |
| 2,993,658 | 7/1961 | Sweeney | 312/39 X |
| 3,598,331 | 8/1971 | Okamura | 242/55.3 |
| 3,698,653 | 10/1972 | Okamura | 242/55.3 |
| 3,865,295 | 2/1975 | Okamura | 242/55.3 X |
| 4,432,482 | 2/1984 | Beausoleil | 226/181 |

*Primary Examiner*—David Werner

*Attorney, Agent, or Firm*—Basile and Hanlon

[57] ABSTRACT

A paper roll dispenser capable of storing at least one unused roll of paper therein. The dispenser comprises an open bottomed cabinet which includes an apertured front, two opposed sides and a lid. A vertical groove is formed on the interior face of each of the opposed sides at corresponding locations. The grooves typically have one closed end at the bottom and an open top end. Notched members are disposed on each of the opposed sides above the open top ends of the grooves. The notched members may be laterally displaced from a first position wherein the notches do not align with the grooves to a second position wherein the notches align with the grooves. The notched members are normally biased toward the first position by a spring. A push bar interconnects the notched members at the front ends thereof and extends through the aperture in the front of the cabinet. When urged against the spring, the push bar displaces the notched members into their second position.

6 Claims, 2 Drawing Sheets

PAPER ROLL DISPENSER

BACKGROUND OF THE INVENTION

1. Field of the Invention

This invention relates to paper roll dispensers, and especially to paper roll dispensers capable of storing at least one unused roll therein.

2. Description of the Prior Art

Cabinet type dispensers for the dispensing of paper products such as paper towels, toilet paper or any type of paper product commonly manufactured and distributed in the form of a continuous roll wound around a central tubular reel are well known in the prior art. By means of such cabinet type dispensers, the user may unroll the desired amount of paper product and detach it from the roll.

It is also known to provide cabinet type paper roll dispensers having room inside for the storage of at least one unused roll. Typically, the unused roll is stored near the top the cabinet and may be accessed by means of a cabinet lid. After the unused roll is removed from the cabinet, it must be installed so as to be made available for use. Thus, the removal and installation of the new roll is a multi-step process of considerable inconvenience to the user.

It would be desirable to provide a paper roll dispensing cabinet capable of storing at least one unused roll wherein the unused roll may be installed without removing it from the cabinet. It would also be desirable to provide a cabinet wherein the unused roll may be installed for usage by simply pushing or pressing a spring-biased push bar or button.

SUMMARY OF THE INVENTION

The invention herein provides a paper roll dispenser capable of storing at least one unused roll therein, which provides an open bottomed cabinet with a mechanism therein for releasing an unused paper roll from a storage position to an installed position.

The open bottomed cabinet includes an apertured front, two opposed sides and a lid. Optionally, the cabinet may also include a back. A separate roll holding member may be disposed in the bottom of the cabinet and releasably mountable thereto by means of conventional latches. A vertical groove is formed in each of the opposed sides at corresponding locations therein, which may continue on in the roll holding member, if provided. The width of the grooves is large enough to accommodate the end of a tubular reel upon which the paper roll is wound. The vertically disposed grooves each have an open top end. A notched member is disposed on each of the opposed sides at locations immediately above the open groove ends. Each notched member is laterally displacable from a first position wherein its notch is unaligned with the corresponding groove to a second position wherein its notch is aligned with the groove. The notched members are normally biased toward the first position by a biasing means which is disposed on the opposed sides of the cabinet proximate the rear edges thereof. The biasing means typically comprises a spring.

A push means interconnects the notched members at their front ends. The push means extends through the aperture in the front of the cabinet. When the push means is urged against the biasing means, it displaces the notched members to the second position thereby causing the notches to align with the corresponding grooves.

In normal usage, the paper roll dispenser of the instant invention has a roll of paper installed by having the tubular reel ends disposed in the opposed grooves. A stop means will prevent the paper roll from falling out of the open bottom of the cabinet, or out of the optional roll holding member. An unused roll of paper will be placed in the top of the cabinet, to which access is gained by the removable lid, and will be supported at the tubular reel ends by the notched members. After the roll of paper disposed in the grooves is used up, its tubular reel may be easily be removed, especially if the optional removable roll holding member is provided. By pushing the push means in the front of the cabinet, the notched members will be laterally displaced into their second position. As the notches of the notched members become aligned with the corresponding grooves, the unused roll of paper will no longer be supported by the notched members and the ends of the tubular reel will fall through the notches and down the grooves until they are caught by the stop means. The new roll will then be available for immediate use.

By means of the herein disclosed invention, an unused roll of paper may be easily and quickly installed in a one-step procedure in the cabinet.

BRIEF DESCRIPTION OF THE DRAWINGS

The various features, advantages and other uses of the present invention will become more apparent by referring to the following detailed description and drawings in which.

DETAILED DESCRIPTION OF THE PREFERRED EMBODIMENT

Figure 1:
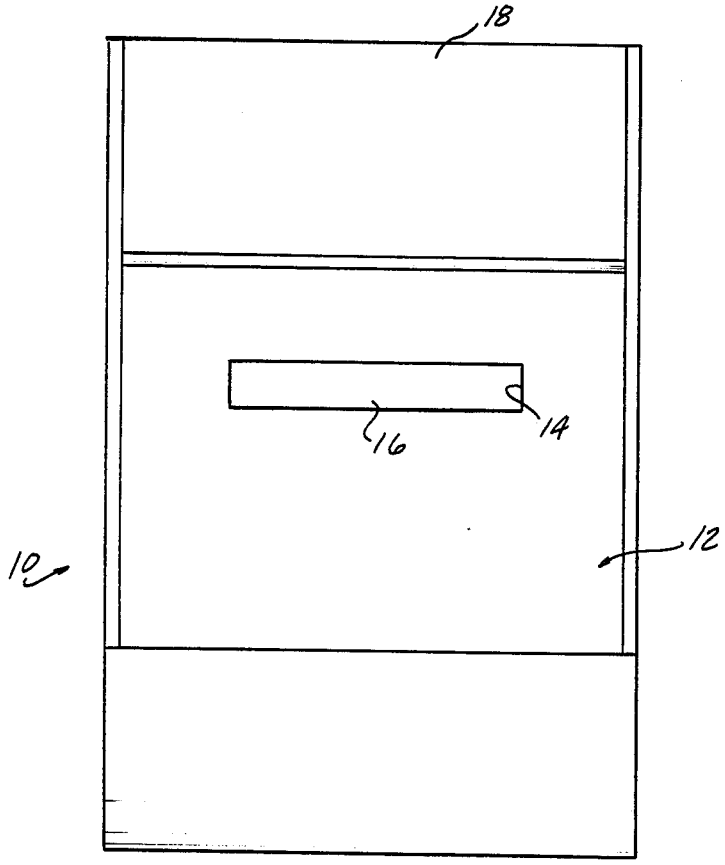
FIG. 1 is a front elevational view of a paper roll dispenser constructed in accordance with the teachings of the present invention.

Reference is made to FIGS. 1–4 in which like numbered reference numerals are used to delineate the same feature in multiple figures thereof. In FIG. 1 there is depicted a paper roll dispenser 10 of the present invention shown in a front elevational view. The front of the cabinet 12 contains an aperture 14 formed therein. A push bar 16 projects through the aperture 14. A lid 18 forms the top of the cabinet 10. Typically, lid 18 will be hinged at its rear edge to permit easy access to the interior of the cabinet 10. Optionally, a separate roll holding member 38 is provided, which is latchable to opposed cabinet sides 20 by latch means 40.

Figure 4:
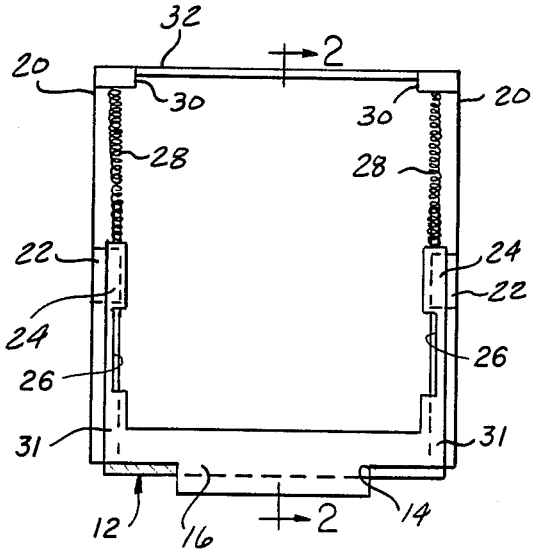
FIG. 4 is a cross-sectional view generally taken along line 4—4 in FIG. 2 of the dispenser of FIG. 1 showing the relationship of the notches and grooves when the notched members are in the first position.
Figure 2:
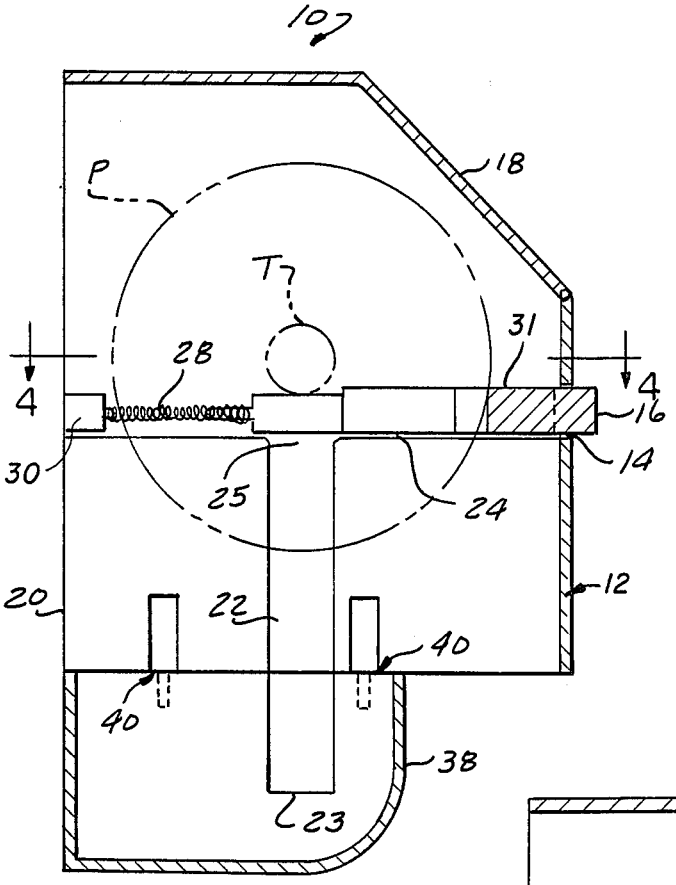
FIG. 2 is a part-sectional side view generally taken along line 2—2 in FIG. 4 of the paper roll dispenser of FIG. 1 showing an unused roll of paper in the storage position.
Figure 3:
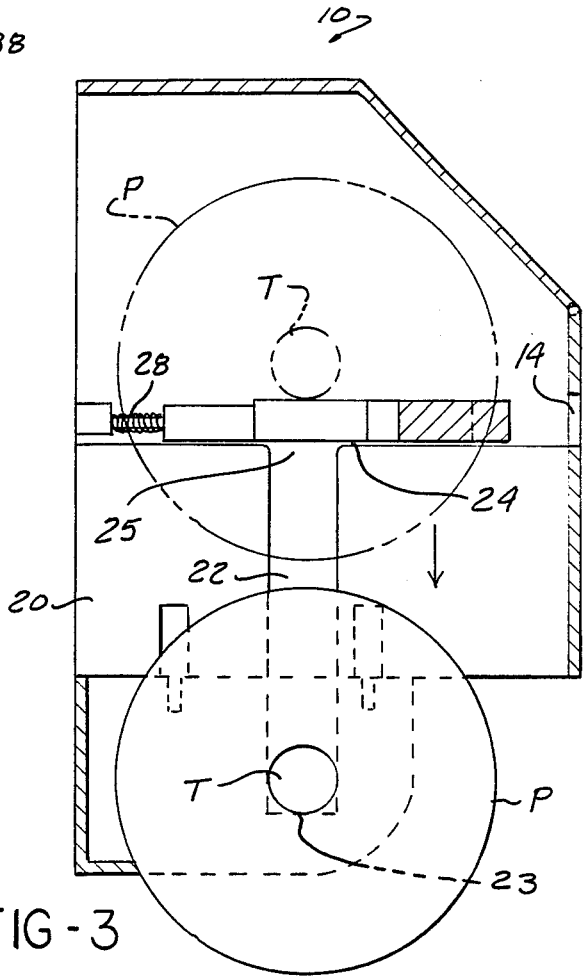
FIG. 3 illustrates the unused paper roll of FIG. 2 displaced into its installed position.

The interior of the cabinet 10 may be seen depicted in FIGS. 2, 3 and 4. The two opposed sides 20 each have formed therein a vertically disposed groove 22, which continues on into separate roll holding member 38. Disposed near the bottom of the cabinet 10 is a stop means 23 which is depicted in FIGS. 2 and 3 as a closed end to the groove 22. Grooves 22 may be formed in opposed side wall 20 and roll holding member 38 by any of a variety of means. For example, a groove 22 may be molded into the side wall 20 and roll holding member 38. Alternatively, a separate piece with a molded groove therein may be disposed immediately adjacent side 20 and roll holding member 38. Alternatively, the sides of the groove 22 may be formed by elongated members attached to side 20. The exact method of forming groove 22 is considered to be a matter of design choice and within the scope of one familiar with the art. However it is formed, groove 22 has an open end 25 formed at its top.

Figure 5:
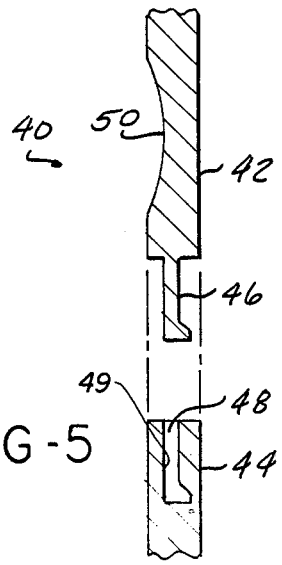
FIG. 5 is a detailed view of the latching means.

A notched member 24 is disposed along the interior of each of opposed sides 20 and above the open groove end 25. Notched member 24 has formed therein a notch 26 which is, in the preferred embodiment, somewhat wider than the width of the groove 22. Notched member 24 is laterally displacable from a first position wherein its notch 26 is unaligned with the groove 22 to a second position wherein the notch 26 is aligned with the groove 22. The notched members 24 are normally biased toward the first position. That is, the groove 22 is normally unaligned with the notch 26 and disposed between it and the back of the cabinet. A biasing means 28 is disposed on each of opposed sides 20 near a back edge thereof. Typically, biasing means 28 will comprise a spring 28. Spring 28 engages at one end thereof the notched member 24. At its other end, spring 28 is attached to the cabinet side 20. As depicted in FIGS. 3, 4 and 5, the other end of spring 28 is attached to a mounting block 30 which is attached to cabinet side 20.

As best seen in FIG. 4, a push means such as push bar 16 interconnects the notched members 24 at the front ends 31 thereof. When the push bar 16 is urged against the biasing means 28, the notched members 24 will be displaced to the second position, wherein the notches 26 will align with the grooves 22.

An example of latching means 40 is shown in detail in FIG. 5. A member 42 has formed thereon a hook shaped projection 46. A pair of members 42 are mounted on each opposed cabinet side 20 adjacent a rear edge thereof. Mounted on corresponding locations on the sides of roll holding members 38 near a top edge thereof of are member 44 which have formed therein apertures 48. Each aperture 48 is suitably shaped to receive a hook shaped projection 46, and has an inclined back face 49. Because back face 49 is inclined, hook shaped projection 46 may be easily inserted into aperture 48. To aid in ease of latching roll holding member 38 to cabinet 12, each member 42 has a narrowed portion formed by a concave cut 50 therein, as shown in FIG. 5. If each member 42 is formed of a resilient material such as a plastic, pushing on the side of member 42 opposite concave cut 50 will cause member 42 to flex, thereby putting hook-like projection 46 into correct alignment for insertion into aperture 48. After insertion thereof, the pressure on member 42 is released, causing member 42 to flex back to its original position, thereby creating a secure snap-fit between members 42 and 44. Roll holding member 38 may be removed from cabinet 12 by, again, pressing member 42 and causing flexion thereof.

The method of operation of the paper roll dispenser 10 of the present invention will now be described with reference to FIGS. 2 and 3. In FIG. 2, an unused roll of paper P has been placed into the top of the cabinet 12 by opening the hinged lid 18, thereby gaining access thereto. Unused paper roll P is of the type in which a continuous roll of paper is wound around a tubular reel (not shown). At each side of paper roll P the tube end T will project for a short distance therefrom. The width of cabinet 12 is such that the tube ends P of paper roll P will rest on and be supported on the unnotched portions of notched members 24. The unused paper roll P will remain in this position as long as notched members 24 remain in their first position.

When it is desired to install unused paper roll P and make it available for use, the user need only push the push bar 16. This will cause lateral displacement of notched members 24 to their second position. Notches 26 will become aligned with grooves 22. The paper roll P will then become unsupported because the tube ends T will no longer be supported by the notched members 24, thereby causing paper roll P to fall through notches 26 and open groove ends 25, and down grooves 22. When the paper roll P reaches the stop means 23, it will be retained in that position. Paper roll P in the installed position with its tube ends T held by the stop means 23 is depicted in FIG. 3. In FIG. 3, paper roll P is now available for use.

Optionally, cabinet 12 may further include a back 32. This embodiment is depicted in FIG. 4. If cabinet 12 does not include a back, the cabinet may be directly mounted to a wall or other surface. If the back 32 is included, the back 32 will normally be mounted to a wall or other surface.

While the push means has been depicted as push bar 16, it may comprise other than a bar shape, for example, it may be a round push button. It is expected that various structures of the paper roll dispenser described and claimed herein may exhibit a variety of designs without departing from the spirit of the inventive concept disclosed herein.

In summary, there has been disclosed a paper roll dispenser of the cabinet type in which at least one unused roll of paper may be stored. The unused roll of paper may be easily installed for usage by simply pressing a push means to cause displacement of notched members disposed within the cabinet, thereby causing their notches to align with grooves formed in the opposed side walls of the cabinet. Upon alignment, the roll of paper will fall into the installed position.

I claim:

1. A paper roll dispenser for the storage and subsequent use of at least one unused roll of paper of the type having a central tube therein with projecting tube ends, said dispenser comprising:

an open bottomed cabinet including a front having an aperture therein, two opposed sides and a lid;

a continuous vertical groove partially disposed on each of the opposed sides at corresponding locations thereon, said groove having an open end medial of the lid and the open bottom of the cabinet and a closed bottom end for supporting a paper roll in a dispensing position;

a notched member disposed on each of the opposed sides at a point above the open groove ends, said notched members each including a notch and each being laterally displaced from a first position wherein the notch is unaligned with the groove and an unused paper roll disposed above the notched members is supported at each tube end by the notched members to a second position wherein the notch is aligned with the groove and each paper tube end becomes unsupported, thereby causing the unused roll to fall to the bottom of the cabinet until it is caught by the bottom ends of the grooves;

biasing means disposed on the sides of the cabinet for biasing the notched members toward the first position; and push means interconnecting the notched members at front ends thereof, said push means extending through the aperture in the front of the cabinet and, when urged against the biasing means, displaces the notched members to the second position.

2. The paper roll dispenser of claim 1 wherein the width of the grooves and of the notches is large enough to accommodate the tube ends.

3. The paper roll dispenser of claim 1 wherein the biasing means comprises a spring disposed near a rear edge of each of the opposed sides and having a first and a second end, the first end being attached to the cabinet and the second end engaging the back end of the notched member.

4. The paper roll dispenser of claim 1 wherein the vertical grooves are integral with the opposed side walls.

5. The paper roll dispenser of claim 1 further comprising a roll holding member releasably mounted by latching means to the bottom of the cabinet.

6. A paper roll dispenser for the storage and subsequent use of at least one unused roll of paper of the type having a central tube therein with projecting tube ends, said dispenser comprising:

an open bottomed cabinet including a front having an aperture therein, two opposed sides and a hinged lid;

a continuous vertical groove partially disposed on each of the opposed sides at corresponding locations thereon, said groove having an open end medial of the lid and the open bottom of the cabinet, a width large enough to accommodate the tube ends, and a closed off bottom end for supporting the unused roll of paper in a dispensing position;

a notched member disposed on each of the opposed sides at a point above the open groove ends, said notched members each including a notch and being laterally displaced from a first position wherein the notch is unaligned with the groove and an unused paper roll disposed above the notched members is supported at each tube end by a notched member to a second position wherein the notch is aligned with the groove and each paper tube end becomes unsupported, thereby causing the unused roll to fall to the bottom of the cabinet until it is caught by the bottom ends of the grooves;

a spring disposed near a rear edge of the opposed sides and having a first and a second end, the first end being attached to the cabinet and the second end engaging the back end of the notched member for biasing the notched member toward the first position; and a push bar interconnecting the notched members at front ends thereof, said push bar extending through the aperture in the front of the cabinet and, when urged against the spring, displaces the notched members to the second position.

* * * * *